US009090376B2

(12) United States Patent
Longberg et al.

(10) Patent No.: US 9,090,376 B2
(45) Date of Patent: Jul. 28, 2015

(54) MERCHANDISE STORAGE CONTAINER WITH RETAINING TABS

(71) Applicant: Wynalda Litho, Inc., Belmont, MI (US)

(72) Inventors: Daniel Paul Longberg, Rockford, MI (US); Robert G. Rajter, Jr., Rockford, MI (US)

(73) Assignee: Wynalda Litho, Inc., Belmont, MI (US)

( * ) Notice: Subject to any disclaimer, the term of this patent is extended or adjusted under 35 U.S.C. 154(b) by 0 days.

(21) Appl. No.: 14/162,585

(22) Filed: Jan. 23, 2014

(65) Prior Publication Data

US 2014/0202911 A1 Jul. 24, 2014

Related U.S. Application Data

(60) Provisional application No. 61/755,532, filed on Jan. 23, 2013.

(51) Int. Cl.
*B65D 5/42* (2006.01)
*B65D 5/02* (2006.01)

(52) U.S. Cl.
CPC ..... *B65D 5/4262* (2013.01); *B65D 5/0209* (2013.01); *B65D 2203/00* (2013.01)

(58) Field of Classification Search
CPC . B65D 5/4262; B65D 5/0209; B65D 2203/00
USPC ..... 229/116.1, 118, 128; 40/312
See application file for complete search history.

(56) References Cited

U.S. PATENT DOCUMENTS

| | | | | | |
|---|---|---|---|---|---|
| 2,050,894 | A * | 8/1936 | Paige | 229/116.1 |
| 2,279,233 | A * | 4/1942 | Groves | 229/155 |
| 3,010,571 | A * | 11/1961 | Transport | 229/128 |
| 3,126,660 | A * | 3/1964 | Meyers | 40/312 |
| 5,219,116 | A * | 6/1993 | Hearne | 229/118 |
| 5,366,102 | A * | 11/1994 | Bergner et al. | 206/459.5 |
| 5,924,626 | A * | 7/1999 | Whitnell | 229/128 |
| 5,960,949 | A | 10/1999 | Wynalda, Jr. | |
| 6,845,865 | B2 | 1/2005 | Wynalda, Jr. | |
| 7,124,890 | B2 * | 10/2006 | McLeod et al. | 229/915 |
| 2005/0133397 | A1 * | 6/2005 | Mehling | 206/459.5 |
| 2007/0205135 | A1 * | 9/2007 | Goldman et al. | 206/459.5 |
| 2008/0017536 | A1 | 1/2008 | Wynalda, Jr. | |
| 2009/0194442 | A1 | 8/2009 | Wynalda, Jr. | |
| 2009/0288968 | A1 | 11/2009 | Wynalda, Jr. | |

* cited by examiner

*Primary Examiner* — Gary Elkins
(74) *Attorney, Agent, or Firm* — Zollinger & Burleson Ltd.

(57) ABSTRACT

A merchandise storage container includes belly band retaining tabs. The retaining tabs are moved to their extended positions when the merchandise storage container is formed. The retaining tabs are disposed at the corners of the container so that a belly band used with the container can slide up and down along the length of the container while encountering at least some resistance at the corners before the band separates from the container. The retaining tabs are flexible so that a person can intentionally remove a belly band by pivoting the tabs out of the way or by forcing the belly band over the tabs.

17 Claims, 2 Drawing Sheets

MERCHANDISE STORAGE CONTAINER WITH RETAINING TABS

CROSS REFERENCE TO RELATED APPLICATIONS

This application claims the benefit of U.S. Provisional Patent Application 61/755,532 filed Jan. 23, 2013; the disclosures of which are incorporated herein by reference.

BACKGROUND OF THE DISCLOSURE

1 . Technical Field

The disclosure generally relates to merchandise storage containers and, more particularly, to fold up merchandise storage containers having belly bands. Specifically, the disclosure relates to a fold up merchandise storage container that provides band retaining tabs at the corners of the container for retaining a belly band around the container during use of the container.

2 . Background Information

A popular addition to merchandise storage container is a belly band that wraps around the container. Although belly bands may be used with essentially any size or shaped container, a popular configuration combines a horizontally-disposed belly band with a merchandise storage container that is elongated in a vertical direction. One example of such a container is used to store and display protective phone cases. The companies that sell cell phone cases desire storage containers that attract attention to their products and differentiate their products from the competition. Some companies thus add belly bands around a central portion of the containers to help achieve these goals. Information may be presented on the front of the belly band. A belly band is usually not connected to the container body itself such that the band can slide up and down along the length of the container. The loose nature of the belly band is desirable. A problem with the use of a belly band is that the belly band can slip off the bottom of the containers as the container hang on a display or when customers handle the containers. The belly bands also can slip off the containers during transport. Those who wish to use belly bands with their products desire a way to retain the belly bands on the storage container while maintaining the character of the bands.

SUMMARY OF THE DISCLOSURE

The disclosure provides a merchandise storage container that includes belly band retaining tabs. The retaining tabs are moved to their extended positions when the merchandise storage container is formed. The retaining tabs are disposed at the corners of the container so that a belly band used with the container can slide up and down along the length of the container while encountering at least some resistance at the corners before the band separates from the container. The retaining tabs are flexible so that a person can intentionally remove a belly band by pivoting the tabs out of the way or by forcing the belly band over the tabs.

The disclosure provides a fold up storage container configuration wherein the belly band retaining tabs extend from the hinge walls that connect dust flaps to the sidewalls of the container. The bodies of the retaining tabs are cut from portions of the sidewalls. This material pivots outwardly away from the sidewall to define the retaining tabs when the dust flaps are bent away from the sidewalls.

In one configuration, the disclosure provides a six-sided, fold-up paperboard-based merchandise storage container that defines a storage chamber. The container includes belly band retaining tabs disposed at the corners of the container. The front and rear walls of the container are bowed outwardly.

BRIEF DESCRIPTION OF THE DRAWINGS

Similar numbers refer to similar parts throughout the specification.

DETAILED DESCRIPTION OF THE DISCLOSURE

Figure 1:
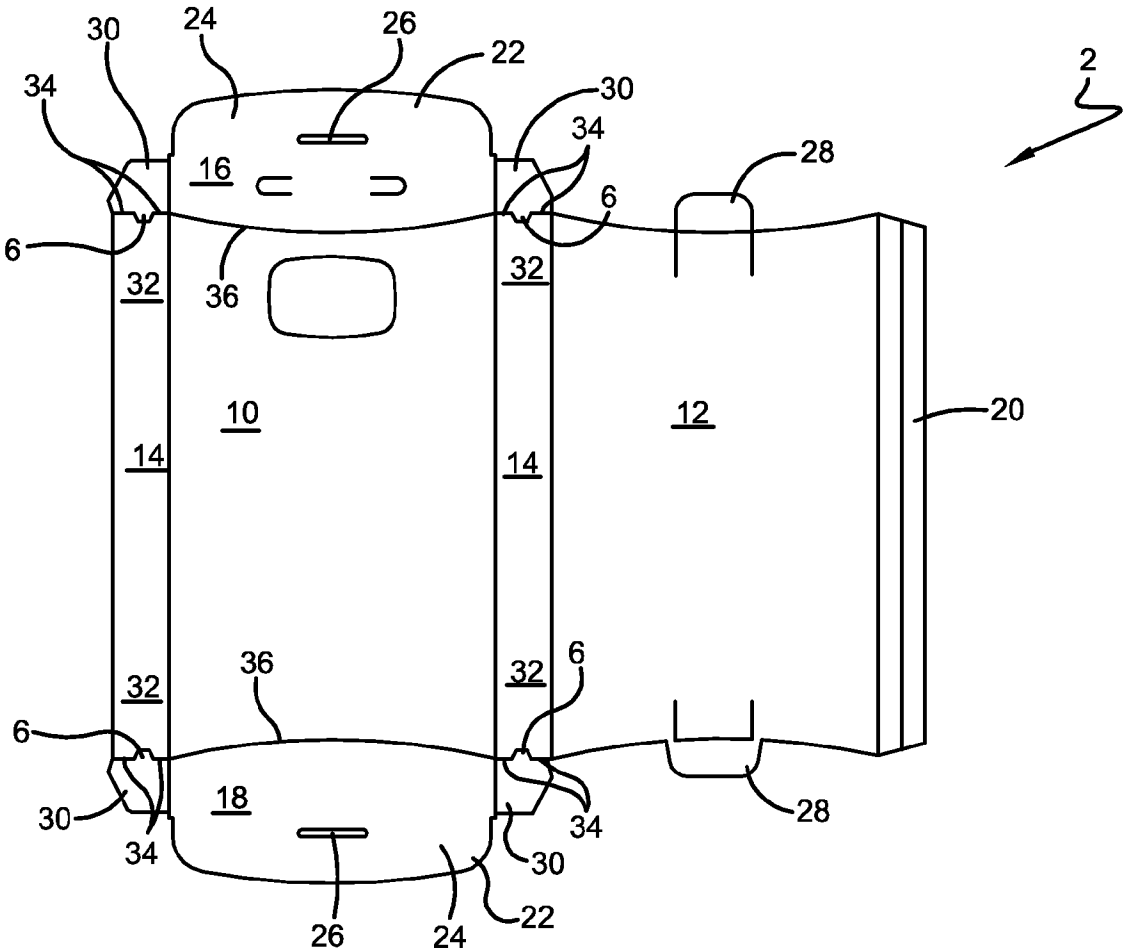
FIG. 1 is a plan view of a blank for the container.
Figure 3:
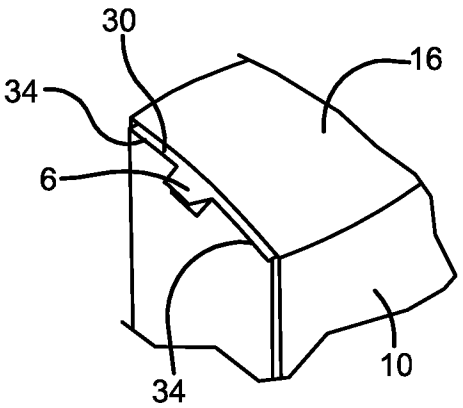
FIG. 3 is an enlarged perspective view of an upper corner of the container of FIG. 2 showing an extended band retaining tab.
Figure 2:
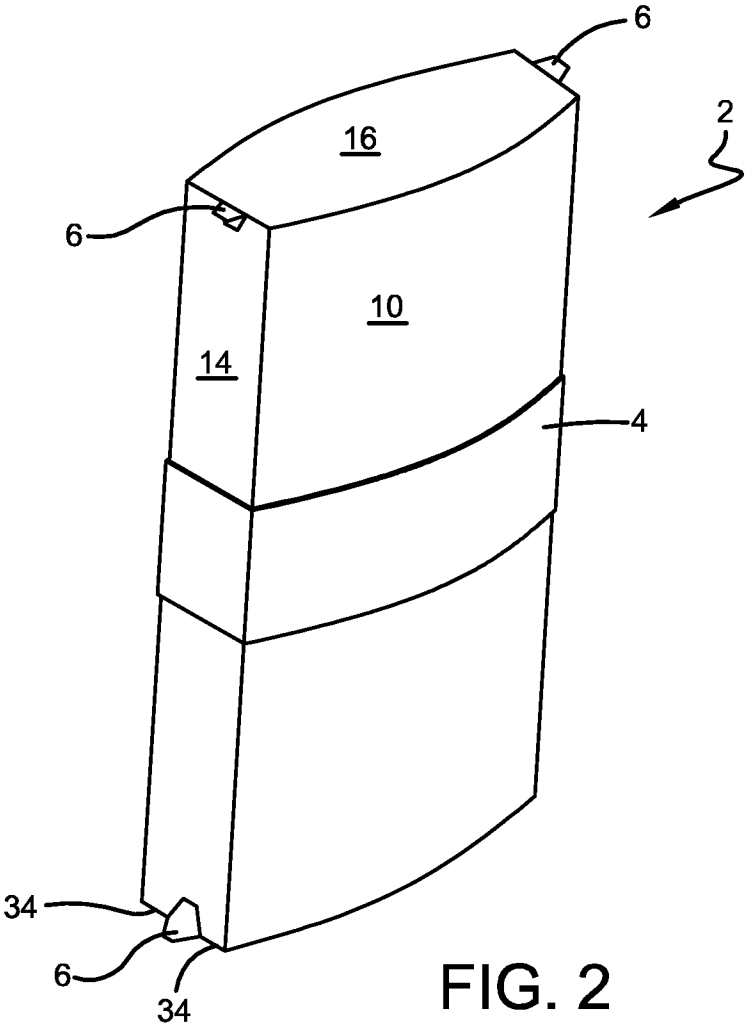
FIG. 2 is a perspective view of the exemplary container with a belly band disposed horizontally about the middle of the container.

The exemplary configuration of the container described herein is indicated generally by the numeral 2. The exemplary configuration of container 2 is a six-sided fold-up container formed from paperboard or polymer-based boards (or any other material that can be cut, scored, and folded into containers) and may be used with a variety of items of merchandise. The exemplary six-sided container 2 can be provided in a wide variety of widths, lengths, and depths. In other embodiments, container 2 is provided is different configurations such as seven-sided or eight-sided containers. Container 2 is designed to be used with belly bands 4 and provides retaining tabs 6 that are used to minimize the likelihood that belly band 4 will fall off of container 2.

In the exemplary configuration shown in the drawings, the front wall 10 and rear wall 12 are bowed outwardly. Bowing the walls outwardly is optional and the belly band retaining tabs 6 of the disclosure may be used with flat walls as well as bowed walls.

Container 2 includes front wall 10, rear wall 12, a pair of sidewalls 14, a top wall 16, and a bottom wall 18. A glue flap 20 extends from the edge 22 of rear wall 12 opposite the connection of rear wall 12 to sidewall 14. Glue flap 20 is adhered to the inner surface of sidewall 14 that is not already connected to rear wall 12 to define a four-sided generally rectangular tube.

In order to provide bowed front and rear walls, the upper and lower edges of the front 10 and rear 12 walls are curved such that the front and rear edges of the top 16 and bottom 18 walls are bowed outwardly when container 2 is formed. When top 16 and bottom 18 walls are folded to be generally perpendicular to front 10 and rear 12 walls, the curved edges bow the front 10 and rear 12 walls outwardly.

Locking flaps 22 extend from top 16 and bottom 18 walls at the edge of top and bottom wall opposite to the connections between top and bottom walls and front wall 10. Each locking flap 22 is connected to top 16 or bottom 18 wall along a fold line 24 that defines a slit 26 sized to receive a locking tab 28 that extends from rear wall 12.

Dust flaps 30 extend from the upper and lower ends 32 of sidewalls 14. Dust flaps 30 are folded perpendicular to sidewalls 14 and are positioned under top 16 and bottom 18 walls when container 2 is assembled. Dust flaps 30 stabilize container 2 and help to seal the corners of container 2 against dust. In this disclosure, dust flaps 30 also provide belly band retaining tabs 6 that limit the movement of belly band 4. Each retaining tab 6 is defined by or formed from a portion of an end 32 of a sidewall 14. Each retaining tab 6 is integrally formed with its adjacent dust flap 30 that is adjacent to that end of sidewall 14. Each dust flap 30 is connected to a sidewall 14 about a dust flap fold line 34. In use, dust flaps 30 are folded generally perpendicular to sidewalls 14 which causes retaining tabs 6 to move outwardly and stick out away from sidewalls 14. In the exemplary configuration, retaining tabs 6 are centrally-positioned with respect to dust flaps 30 and thus fold line 34 is divided into two spaced portions separated by the body of retaining tab 6. In other configurations, retaining tabs 6 may be disposed at the ends of fold lines 34 or multiple retaining tabs 6 may be defined along each fold line 34. Also in this configuration, each retaining tab 6 is defined by three slits in sidewall 14 which include two angled side cuts and a connecting cut. When dust flap 30 is bent along its dust flap fold line 34, retaining tab 6 moves with dust flap 30 about fold line 34 to its extended position. In other configurations, retaining tabs 6 may be scored or perforated so that they do not automatically move outwardly until the user decides to place them into use by breaking the perforations or cutting through the scoring.

Retaining tabs 6 may also be provided on the front and rear of container 2 by cutting tabs 6 out of the end portions of front 10 and rear 12 walls along fold lines 36.

The material for the panels of container may be paperboard or polymer-based board materials provided in a variety of thicknesses suitable for fold up packaging. A 0.014 inch WYN-PET is one exemplary material. Various outer surfaces of container 2 are free of interruptions to allow for printing.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A merchandise storage container comprising:

a container body defining a merchandise storage area;

the container body having a front wall, a rear wall, and first and second sidewalls;

the first sidewall extending between the front wall and the rear wall at a first side of the container body;

the second sidewall extending between the front wall and the rear wall at a second side of the container body;

each of the sidewalls having a first end and a second end;

a flap connected to each end of each sidewall; each flap being movable between first and second positions;

a retaining tab connected to each flap;

each retaining tab being substantially perpendicular to the sidewall to which its flap is connected when the flap is in the second position; and top and bottom walls; the flaps connected to the first ends of the sidewalls being disposed under the top wall when the flaps are in the second position and the flaps connected to the second ends of the sidewalls being disposed under the bottom wall when the flaps are in the second position;

the retaining tabs extending out from under either one of the top and bottom walls when the flaps are in the second position.

2. The container of claim 1, further comprising a band disposed around the container body between the ends of the sidewalls.

3. The container of claim 1, wherein the front and rear walls are bowed outwardly.

4. The container of claim 1, wherein each retaining tab is disposed substantially parallel to the sidewall to which its flap is connected when each flap is in the first position.

5. The container of claim 1, wherein each flap is connected to its sidewall with a pair of spaced fold lines; the retaining tab connected to the flap being disposed between the fold lines.

6. The container of claim 5, wherein the each retaining tab is centered with respect to the sidewall to which its flap is connected.

7. The container of claim 6, wherein the container body is fabricated from paperboard.

8. A merchandise storage container comprising:

a container body defining a merchandise storage area; the container body being formed from a foldable material;

the container body having a front wall, a rear wall, and first and second sidewalls;

the first sidewall extending between the front wall and the rear wall at a first side of the container body;

the second sidewall extending between the front wall and the rear wall at a second side of the container body;

each of the front wall, the rear wall, and the sidewalls having a first end and a second end;

a top wall connected to the first end of one of the front and rear walls;

a bottom wall connected to the second end of one of the front and rear walls;

a first dust flap connected to the first end of the first sidewall; the first dust flap being movable between first and second positions;

a second dust flap connected to the second end of the first sidewall; the second dust flap being movable between first and second positions;

a third dust flap connected to the first end of the second sidewall; the third dust flap being movable between first and second positions;

a fourth dust flap connected to the second end of the second sidewall; the fourth dust flap being movable between first and second positions;

the first and third dust flaps being disposed under the top wall when the first and third dust flaps are in the second position;

the second and fourth dust flaps being disposed under the bottom wall when the second and fourth dust flaps are in the second position;

a first retaining tab connected to the first dust flap; the first retaining tab projecting outwardly from under the top wall away from the first sidewall when the first dust flap is in the second position;

a second retaining tab connected to the second dust flap; the second retaining tab projecting outwardly from under the bottom wall away from the first sidewall when the second dust flap is in the second position;

a third retaining tab connected to the third dust flap; the third retaining tab projecting outwardly from under the top wall away from the second sidewall when the third dust flap is in the second position;

a fourth retaining tab connected to the fourth dust flap; the fourth retaining tab projecting outwardly from under the bottom wall away from the second sidewall when the fourth dust flap is in the second position; and a band disposed around the container body between the first and second ends of the sidewalls.

9. The container of claim 8, wherein the front and rear walls are bowed outwardly.

10. The container of claim 8, wherein the container body is fabricated from paperboard.

11. The container of claim 8, wherein the first and second retaining tabs are disposed substantially parallel to the first sidewall when first and second dust flaps are in the first position.

12. The container of claim 11, wherein the third and fourth retaining tabs are disposed substantially parallel to the second sidewall when third and fourth dust flaps are in the first position.

13. The container of claim 8, wherein the first dust flap is connected to the first sidewall with a pair of first spaced fold lines; the first retaining tab being connected to the first dust flap between the first spaced fold lines.

14. The container of claim 13, wherein the second dust flap is connected to the first sidewall with a pair of second spaced fold lines; the second retaining tab being connected to the second dust flap between the second spaced fold lines.

15. The container of claim 14, wherein the third dust flap is connected to the second sidewall with a pair of third spaced fold lines; the third retaining tab being connected to the third dust flap between the third spaced fold lines.

16. The container of claim 15, wherein the fourth dust flap is connected to the second sidewall with a pair of fourth spaced fold lines; the fourth retaining tab being connected to the fourth dust flap between the fourth spaced fold lines.

17. The container of claim 8, wherein the first and second retaining tabs are centered with respect to the first sidewall and the third and fourth retaining tabs are centered with respect to the second sidewall.

* * * * *